US008191493B2

(12) United States Patent
Baywol

(10) Patent No.: US 8,191,493 B2
(45) Date of Patent: Jun. 5, 2012

(54) BOAT DRIVE-SUPPORTED WAKE GENERATING DEVICE

(76) Inventor: Roger J Baywol, Grand Blanc, MI (US)

( * ) Notice: Subject to any disclaimer, the term of this patent is extended or adjusted under 35 U.S.C. 154(b) by 67 days.

(21) Appl. No.: 12/749,931

(22) Filed: Mar. 30, 2010

(65) Prior Publication Data

US 2010/0251952 A1 Oct. 7, 2010

Related U.S. Application Data

(60) Provisional application No. 61/211,535, filed on Apr. 1, 2009.

(51) Int. Cl.
*B63B 1/22* (2006.01)

(52) U.S. Cl. ..... 114/285; 440/53; 440/63

(58) Field of Classification Search ..... 114/274, 114/280, 284, 285, 286; 440/53, 59, 61 F, 440/63

See application file for complete search history.

(56) References Cited

U.S. PATENT DOCUMENTS

| | | | | |
|---|---|---|---|---|
| 5,350,327 | A * | 9/1994 | Self et al. | 114/280 |
| 5,549,071 | A * | 8/1996 | Pigeon et al. | 114/286 |
| 5,860,384 | A * | 1/1999 | Castillo | 114/280 |
| 6,012,408 | A * | 1/2000 | Castillo | 114/280 |
| 6,941,884 | B2 * | 9/2005 | Moore | 114/284 |
| 7,063,031 | B2 * | 6/2006 | Earl et al. | 440/51 |
| 7,707,956 | B2 * | 5/2010 | Moore | 114/284 |

* cited by examiner

*Primary Examiner* — Lars A Olson

(57) ABSTRACT

An apparatus which selectively increases the size of the wake of a boat with an outboard or sterndrive motor system. The apparatus has one or more plates attached to the boat hull which, when rotated below the bottom of the hull, extend into the flow of water when underway, increasing the size of the wake due to the dynamic displacement of water. A support bar mechanism transmits propulsive force from the motor drive unit to the plates to overcome resistive hydraulic loads. Linkages may be used to locate the support bar mechanism. In one embodiment, the support bar mechanism is comprised of a plurality of members and pivots such that the support bar mechanism can be stowed substantially out of the flow of water until larger wakes are desired. In other embodiments, mechanical cable, fluidic, or electrical control systems are used to control the configuration of the support bar mechanism.

2 Claims, 2 Drawing Sheets

BOAT DRIVE-SUPPORTED WAKE GENERATING DEVICE

REFERENCE TO PRIOR APPLICATION

The invention described herein was granted provisional patent 61/211,535 on Apr. 1, 2009.

STATEMENT REGARDING FEDERALLY SPONSORED RESEARCH OR DEVELOPMENT

Not Applicable.

REFERENCE TO SEQUENCE LISTING, TABLE, OR COMPUTER PROGRAM LISTING COMPACT DISC APPENDIX

Not Applicable.

BACKGROUND OF THE INVENTION & DIFFERENCES TO THE PRIOR ART

The use of a boat as a tow vehicle for various water sport activities includes the consideration of a wide range of desired wake characteristics for those sports. At one extreme, a minimal wake is desired for optimal barefoot and slalom skiing, where the wake is generally considered a nuisance. At the other extreme, as large a wake as possible is desired for wakeboarding and wakeskating, where the wake is considered a launch ramp for aerial tricks, and for wakesurfing where the wake face provides the means of conveyance for the rider. Generally, lighter boats with minimal "V" (deadrise) hulls have been used when minimal wakes are desired, while heavier boats with deeper "V" hulls are used to create larger wakes. The use of water ballast in bladders or built-in tanks inside the boat is a common practice to increase the size of the wake of any given boat, thus giving it greater utility as a tow vehicle, but consumes significant interior or storage space, and adds large stresses within the boat structure due to the weight of the water. The present invention is intended to maximize a boat's utility as a tow vehicle by enabling a boat with small wake-creation characteristics to be easily and quickly reconfigured to create larger wakes with little to no loss of interior volume or storage space, and with minimal added weight. A key feature of the invention is the presence of a support bar between the drive unit of an outboard or sterndrive motor which applies propulsive force directly to wake-augmentation plates and in so doing, minimizes stresses that would otherwise be transmitted through the outboard or sterndrive motor mountings and the boat hull to push the wake-augmentation plates through the water.

Devices for the management of a motorboat's attitude when traveling through the water and/or for the creation of a specific or larger wake for certain water sport activities, such as wakeboarding, have been disclosed on certain other previous U.S. Patents. U.S. Pat. No. 6,923,136, addresses the automatic trimming of a boat's trim tabs via interaction with the boat's sterndrive unit or outboard motor, but it and U.S. Pat. Nos. 6,138,601 and 6,167,830 and others which further describe various forms of trim tab devices, are for the stated purpose of changing a boats attitude in the water, primarily during acceleration, by causing lift to occur to the back of the boat, which may or may not have any significant affect on the size of the wake. U.S. Pat. No. 7,434,531 specifically addresses adjusting a boat's wake for water sports, but the hydraulic units used to force down the wake-adjustment plates into the water flow are mounted directly to the boats hull, creating high strains in the hull to manage wakeplate and propulsive loads, which limits the size of the plates.

Similarly, U.S. Pat. Nos. 6,012,408 and 7,140,318 and 5,315,951 and others all describe various devices that mount directly to the boat hull to adjust the attitude or displacement of the rear of the boat to adjust the wake, but have no connection to the components driving the boat so as to minimize the forces being transmitted through the boat hull or transom as the boat is propelled through the water. U.S. Pat. No. 7,063,031 describes a wake control device, and includes a provision for mounting a hydrofoil to an outboard motor aft of the drive unit, with all hydraulic forces from the hydrofoil transmitted through the outboard motor and its mountings to the hull.

BRIEF SUMMARY OF THE INVENTION

The device described herein is intended to provide for the sustained creation of large wakes, utilizing the forward and downward thrust of the drive unit of an outboard or sterndrive motor to provide a forward and downward force upon wake-augmentation plates. Larger wakes are created through the deflection of water downward aft of the boat, while at the same time the downward force conveyed upon the plates prevents the back of the boat from rising. The force between the drive unit and the plates is conveyed by means of a one- or multi-piece support bar. By using such a support bar, forces can be more directly transferred between the drive unit and wake-augmentation plates without significantly stressing the outboard or sterndrive mountings or trim mechanisms, or the boat hull.

DETAILED DESCRIPTION OF THE INVENTION

Figure 1:
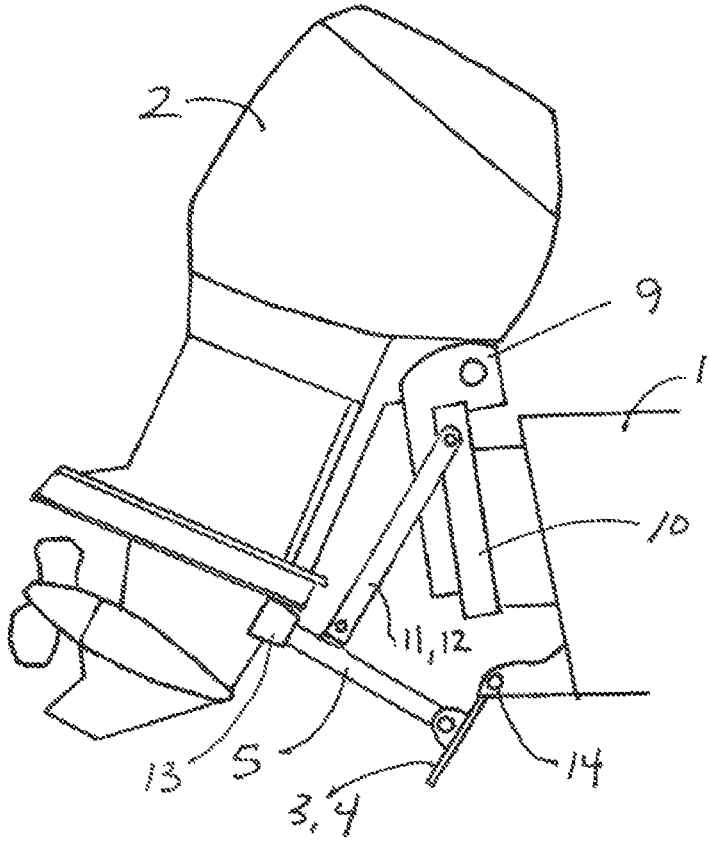
FIG. 1 is a side view of the invention utilizing a one-piece support bar (5) between the drive unit of the outboard motor (2) and wake-augmentation plates (3&4). Outboard motor version is shown, but is similar for sterndrive in the manner in which the device is engaged at the drive unit.
Figure 2:
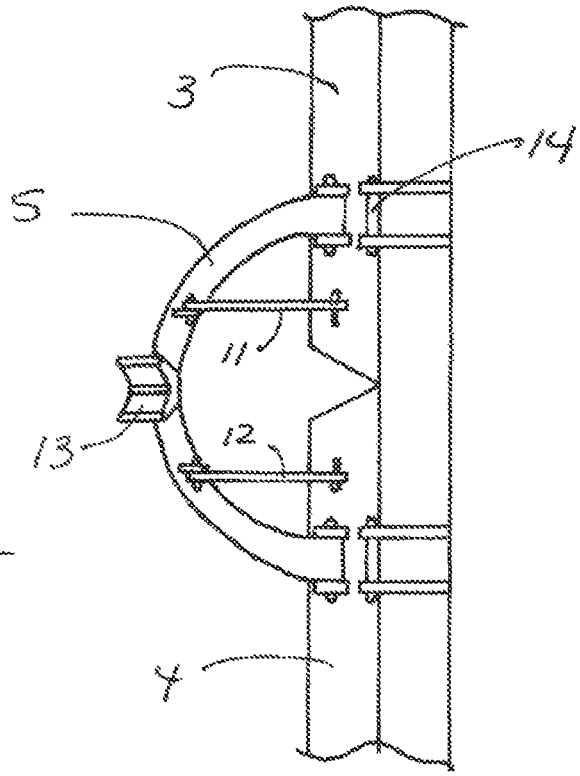
FIG. 2 is a plan view of the invention utilizing a one-piece support bar (5). The outboard motor, boat hull, and jack plate, are not shown in the drawing so as to not obscure the view of the device.
Figure 3:
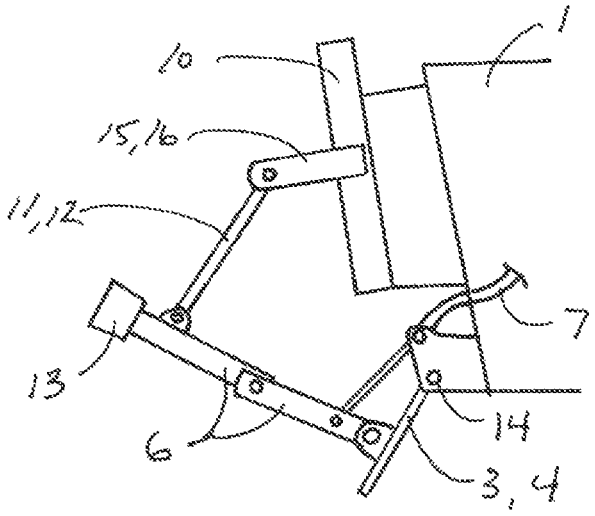
FIG. 3 is a side view of the specific difference in the invention when a multi-piece articulating support bar assembly (6) is used, shown in its drive unit contact position and wake-augmentation plates (3&4) deployed.
Figure 4:
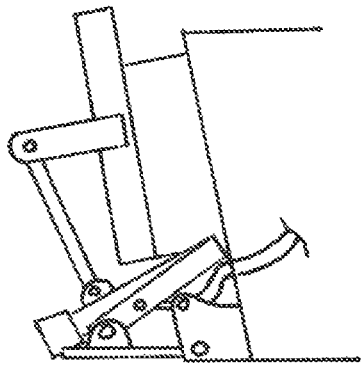
FIG. 4 is an alternate side view of the mechanism of FIG. 3 with the multi-piece support bar assembly (6) shown in the stowed position.
Figure 5:
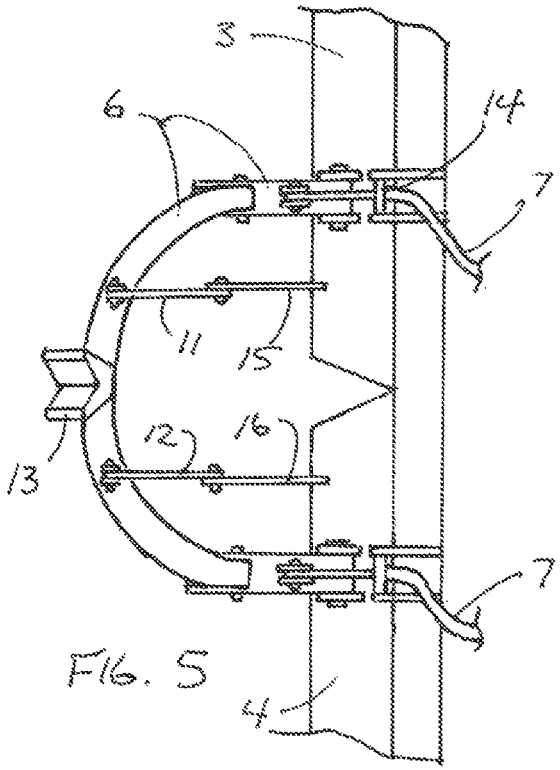
FIG. 5 is plan view of the invention when a multi-piece articulating support bar assembly (6) is used.
Figure 6:
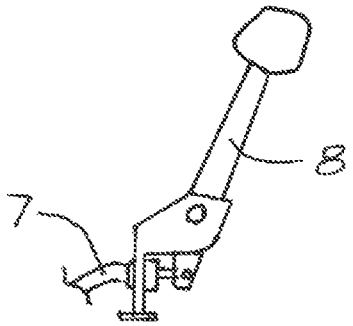
FIG. 6 is a side view of the support bar cable control lever assembly (7), shown in the deployed position.

A boat hull (1) with outboard motor (2) or sterndrive unit has wake-augmentation plates (3&4) with spring-loaded pivots or hinges (14) mounted to the transom. Its motor or drive unit is raised, and a one-piece support bar (5) is installed, or a multi-piece articulating support bar assembly (6) is deployed by cables (7) as controlled from the driver's position or other position by a lever (8), or by a fluidic cylinder or electric actuator with appropriate control. Control linkages (11&12), with or without control linkage brackets (15&16), properly the position the support bar relative to the motor drive unit, with our without yoke (13). Once so configured, and the outboard motor or sterndrive unit is lowered by its integral trim unit (9), the support bar (5 or 6) transmits force from the outboard (2) or sterndrive unit to the wake-augmentation plates (3&4), rotating the plates below the bottom of the hull. As the boat's speed increases, additional propulsive force is transmitted through the support bar to the wake-augmentation plates, and the size of the boat's wake increases via the deflection of the flow of water at the aft end of the boat. A jack plate (10) may optionally be used to further lower an outboard's drive unit into the water flow. Conversely, when the boat's outboard motor or sterndrive unit (2) is raised and the one-piece support bar (5) is removed or the multi-piece support bar (6) is returned to its stowed position via the lever (8) and cables (7) or other actuation means, the wake-augmentation plates (3&4) return to near horizontal. The outboard motor (2) or sterndrive unit can then be lowered back to its normal operating position and the boat return to its normal, small-wake operation.

What is claimed is:

1. An apparatus for increasing the size of the wake of a watercraft powered by at least one outboard motor, the apparatus comprising:

one or more plates mountable and pivotally hinging along an edge near a base of a transom of a hull; and a support bar mechanism comprising a singular or plurality of rigid tubular or non-tubular members affixed and pivoting to said plates and extending to a point immediately forward of a drive unit of the outboard motor, such that the drive unit will contact said support bar mechanism, causing said plates attached to said support mechanism to rotate below the hull of the watercraft and displace water in a downward direction as the watercraft is propelled forward, whereby the wake of the watercraft is increased.

2. An apparatus for increasing the size of the wake of a watercraft powered by at least one sterndrive motor, the apparatus comprising:

one or more plates mountable and pivotally hinging along an edge near a base of a transom of a hull; and a support bar mechanism comprising a singular or plurality of rigid tubular or non-tubular members affixed and pivoting to said plates and extending to a point immediately forward of a drive unit of the sterndrive motor, such that the drive unit will contact said support bar mechanism, causing said plates attached to said support mechanism to rotate below the hull of the watercraft and displace water in a downward direction as the watercraft is propelled forward, whereby the wake of the watercraft is increased.

* * * * *